US011713232B2

(12) United States Patent
Rudick et al.

(10) Patent No.: US 11,713,232 B2
(45) Date of Patent: Aug. 1, 2023

(54) BEVERAGE DISPENSING SYSTEMS

(71) Applicant: The Coca-Cola Company, Atlanta, GA (US)

(72) Inventors: Arthur G. Rudick, Ormond Beach, FL (US); Dick P. Welch, Marietta, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 1157 days.

(21) Appl. No.: 16/337,061

(22) PCT Filed: Sep. 29, 2017

(86) PCT No.: PCT/US2017/054248
§ 371 (c)(1),
(2) Date: Aug. 25, 2021

(87) PCT Pub. No.: WO2018/064451
PCT Pub. Date: Apr. 5, 2018

(65) Prior Publication Data

US 2022/0063980 A1 Mar. 3, 2022

Related U.S. Application Data

(60) Provisional application No. 62/402,110, filed on Sep. 30, 2016.

(51) Int. Cl.

| | |
|---|---|
| ***B67D 1/00*** | (2006.01) |
| ***B67D 1/08*** | (2006.01) |
| *B67D 1/12* | (2006.01) |

(52) U.S. Cl.
CPC ..... *B67D 1/0031* (2013.01); *B67D 1/0034* (2013.01); *B67D 1/0871* (2013.01);
(Continued)

(58) Field of Classification Search
CPC .. B67D 1/0031; B67D 1/0034; B67D 1/0871; B67D 2001/0091; B67D 2001/0093;
(Continued)

(56) References Cited

U.S. PATENT DOCUMENTS 3,359,977 A * 12/1967 Burke ..... A61M 5/162 55/420
5,381,926 A 1/1995 Credle, Jr. et al.
5,803,320 A * 9/1998 Cutting ..... B67D 1/0871 222/129.1

(Continued)

FOREIGN PATENT DOCUMENTS

DE 3709161 A1 10/1987
EP 0253406 A2 1/1988

(Continued)

OTHER PUBLICATIONS

International Search Report and Written Opinion, PCT/US2017/054248, dated Jan. 5, 2018 (11 pp ).

*Primary Examiner* — Donnell A Long
(74) *Attorney, Agent, or Firm* — Eversheds Sutherland (US) LLP

(57) ABSTRACT

The present application provides a beverage dispensing system for combining a number of ingredients. The beverage dispensing system may include an ingredient pouch, an ingredient storage tank, a pump, a nozzle, an inlet diverter valve upstream of the pump, and an outlet diverter valve downstream of the pump.

13 Claims, 14 Drawing Sheets

(52) U.S. Cl.
CPC ..... *B67D 2001/0091* (2013.01); *B67D 2001/0093* (2013.01); *B67D 2001/0827* (2013.01); *B67D 2001/1259* (2013.01); *B67D 2210/0012* (2013.01); *B67D 2210/00152* (2013.01); *B67D 2210/00163* (2013.01)

(58) Field of Classification Search
CPC .... B67D 2001/0827; B67D 2001/1259; B67D 2210/0012; B67D 2210/00152; B67D 2210/00163; B67D 1/1247
See application file for complete search history.

(56) References Cited

U.S. PATENT DOCUMENTS 6,148,838 A * 11/2000 Tsay ..... B67D 7/78 222/64
7,293,675 B1 * 11/2007 Luhn ..... B67D 1/07 222/105
2001/0006176 A1 7/2001 Haselden, Jr.
2003/0106907 A1 * 6/2003 Harrison ..... B05B 11/1097 222/383.1
2007/0056994 A1 3/2007 Woodnorth et al.
2007/0267441 A1 * 11/2007 van Opstal ..... B67D 1/07 222/145.6
2013/0015199 A1 1/2013 Tavolazzi
2016/0046478 A1 * 2/2016 Orita ..... B67D 1/0871 222/64

FOREIGN PATENT DOCUMENTS

EP 3288433 A1 3/2018
JP 2004521638 A 7/2004
WO 9002702 A1 3/1990

* cited by examiner

BEVERAGE DISPENSING SYSTEMS

TECHNICAL FIELD

The present application and the resultant patent relate generally to beverage dispensing systems and more particularly relate to beverage dispensing systems that limit the amount of beverage ingredients such as micro-ingredients and the like that may be lost during ingredient pouch replacement, during system priming, and during other operations.

BACKGROUND OF THE INVENTION

Beverage dispensers traditionally have combined a diluent such as water with a beverage base such as a syrup to create a branded beverage. The beverage bases usually have a diluent reconstitution ratio of about three to one (3:1) to about six to one (6:1). The beverage bases usually come in large bag-in-box containers that may require a significant amount of storage space and may need to be refrigerated. These requirements often necessitate the need to store the bag-in-box containers remotely from the beverage dispenser and to run long lines from the containers to the beverage dispenser.

The "COCA-COLA FREESTYLE®" refrigerated beverage dispensing unit offered by The Coca-Cola Company of Atlanta, Ga. provides a significant increase in the number and types of beverages that may be offered by a beverage dispenser of a conventional size or footprint. Generally described, the "COCA-COLA FREESTYLE®" refrigerated beverage dispensing unit creates a beverage by combining a number of highly concentrated micro-ingredients with a macro-ingredient such as a sweetener and a diluent such as still or carbonated water. The micro-ingredients generally are stored in pouches or cartridges positioned within the beverage dispenser itself. The number and type of beverages offered by the beverage dispenser thus may be limited only by the number and type of micro-ingredient pouches positioned therein.

When an ingredient is depleted in current micro-ingredient dispensers, the branded beverage associated with that ingredient immediately becomes unavailable until the ingredient pouch is replaced. Current micro-ingredient dispensers, however, may leave a significant amount of ingredient remnants in the pouch after the sold-out is registered. Similarly, current micro-ingredient dispensers may waste some of the ingredients to prime the dispenser after each new pouch is inserted.

SUMMARY OF THE INVENTION

The present application and the resultant patent thus provide a beverage dispensing system. The beverage dispensing system may include an ingredient pouch, an ingredient storage tank, a pump, a nozzle, an inlet diverter valve upstream of the pump, and an outlet diverter valve downstream of the pump.

The outlet diverter valve includes a first outlet configuration for the pump to pump the ingredient from the ingredient pouch to the nozzle and a second outlet configuration for the pump to pump the ingredient from the ingredient pouch to the ingredient storage tank. The inlet diverter valve includes a first inlet configuration for the pump to pump the ingredient from the ingredient pouch to the nozzle and a second inlet configuration for the pump to pump the ingredient from the ingredient storage tank to the nozzle or to recirculate the ingredient in the ingredient storage tank.

The present applicant and the resultant patent further provide a method of pumping an ingredient from an ingredient pouch to a nozzle. The method may include the steps of pumping the ingredient to the nozzle, determining a low level of the ingredient in the ingredient pouch, pumping the remaining ingredient to an ingredient storage tank, and replacing the ingredient pouch.

The present application and the resultant patent further provide a beverage dispensing system for combining a number of ingredients. The beverage dispensing system may include an ingredient pouch, an ingredient storage tank, a pump, a solenoid valve downstream of the pump, a nozzle downstream of the solenoid valve, and a recirculation line downstream of the pump and in communication with the ingredient storage tank.

These and other features and improvements of the present application and resultant patent will become apparent to one of ordinary skill in the art upon review of the following detailed description when taken in connection with the several drawings and the appended claims.

DETAILED DESCRIPTION

Figure 1:
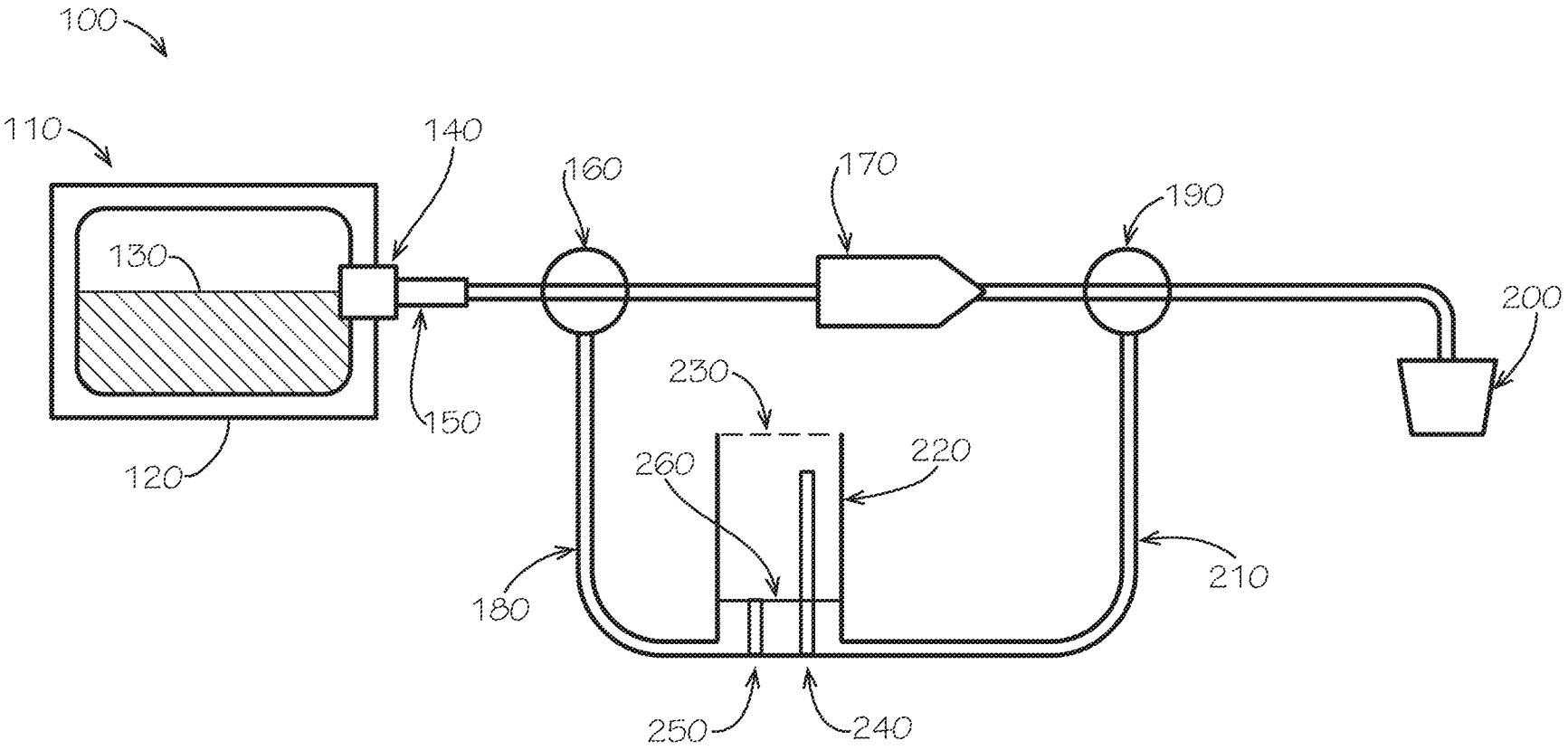
FIG. 1 is a schematic diagram of a beverage dispenser using an ingredient storage tank as may be described herein.

Referring now to the drawings, in which like numerals indicate like elements throughout the several views, FIG. 1 shows an example of a beverage dispenser 100 as may be described herein. The beverage dispenser 100 may use any number of different ingredients. In this example, several different types of ingredients may be used: a diluent, one or more macro-ingredients, and a number of micro-ingredients. Any number or combination of the ingredients may be used herein to create any number of different beverages.

The diluent may include still and/or carbonated water. The diluent may or may not be refrigerated. Other types of diluents may be used herein. A conventional carbonator or a similar type of device may be used to produce carbonated water as desired. The amount of carbonation may be varied.

Generally described, the macro-ingredients may have diluent reconstitution ratios in a range of about three to one (3:1) to about six to one (6:1). Viscosities of the macro-ingredients typically range from about 100 centipoise or higher. By way of example, the macro-ingredients may include sugar syrup, HFCS (high fructose corn syrup), juice concentrates, and similar types of fluids. Similarly, a macro-ingredient base product may include sweetener, acid, and other components. The syrups, sweeteners, and base products generally may be stored in a conventional bag-in-box container. The bag-in-box containers and the macro-ingredients may be positioned remotely from the beverage dispenser 100 and/or positioned thereabout in whole or in part. The macro-ingredients may or may not need to be refrigerated. Other types of macro-ingredients may be used herein.

The micro-ingredients may have diluent reconstitution ratios ranging from about ten to one (10:1), twenty to one (20:1), thirty to one (30:1), or higher. Specifically, many micro-ingredients may have a dilution reconstitution ratio in the range of fifty to one (50:1), to three hundred to one (300:1), or more. The viscosities of the micro-ingredients 60 typically range from about 1 to about 7 centipoise or so. Examples of the micro-ingredients include natural and artificial flavors; flavor additives, e.g., phosphoric acid; natural and artificial colors; artificial sweeteners (high potency, non-nutritive, or otherwise); additives for controlling tartness, e.g., citric acid, potassium citrate; functional additives such as vitamins, minerals, herbal extracts; nutraceuticals; and over-the-counter (or otherwise) medicines. The acid and non-acid components of the non-sweetened concentrate also may be separated and stored individually. The micro-ingredients may be liquid, powder (solid), or gaseous form and/or combinations thereof. The micro-ingredients may or may not require refrigeration. Non-beverage substances such as paints, dyes, oils, cosmetics, etc., also may be used. Various types of alcohols may be used as micro-ingredients or macro-ingredients. Other types of micro-ingredients may be used herein.

FIG. 1 shows an example of a micro-ingredient channel 110 that may be used with the beverage dispenser 100. The beverage dispenser 100 may have any number of the micro-ingredient channels 110. Each of the micro-ingredient channels 110 may have an ingredient pouch 120 or other type of container with a volume of an ingredient 130 therein. The ingredient 130 may be a micro-ingredient, a macro-ingredient, or to otherwise. Each ingredient pouch 120 may include a female IPN fitting 140 which, in turn, interfaces with a male IPN fitting 150 of the micro-ingredient channel 110 (or vice versa). The male IPN fitting 150 may be connected to an inlet three-way diverter valve 160 or other type of connection or flow control device. The inlet three-way diverter valve 160 may be selectably connected to an inlet of a pump 170 via a first storage tube 180. The pump 170 may be any type of accurate metering pump such as a solenoid pump, ceramic metering pump, and the like. The outlet of the pump 170 may be connected to an outlet three-way diverter valve 190 or other type of connection or flow control device. The outlet three-way diverter valve 190 may be selectably connected to a nozzle 200. A second storage tube 210 may connect the outlet three-way diverter valve 190 to an ingredient storage tank 220 while the first storage tube 180 may connect the ingredient storage tank 220 to the inlet three-way diverter valve 160. The ingredient storage tank 220 may be covered with a membrane 230 and the like in whole or in part. The membrane 230 may be a micro-filter that may allow air to pass therethrough but may substantially keep contaminants out. Specifically the membrane 230 may be a silicone membrane that is impervious to liquids and contaminants, but allows gas to pass therethrough. The ingredient storage tank 220 may contain a high-level probe 240 and low-level probe 250. The level probes 240, 250 may be of conventional design. All aspects of the beverage dispenser 100 may be regulated by a computer controller (not shown). Other components and other configurations may be used herein.

During normal dispensing, the ingredient 130 may be dispensed from the ingredient pouch 120 to mix with diluent at the nozzle 200 to create any number of beverages. The three-way diverter valves 160, 190 may have a first configuration to allow the ingredient 130 to flow straight from the pouch 120 to the nozzle 200 via the pump 170. Initially, the level of the ingredient 130 in the ingredient storage tank 220 may be approximately equal to the tip of the low level probe 250.

Figure 2:
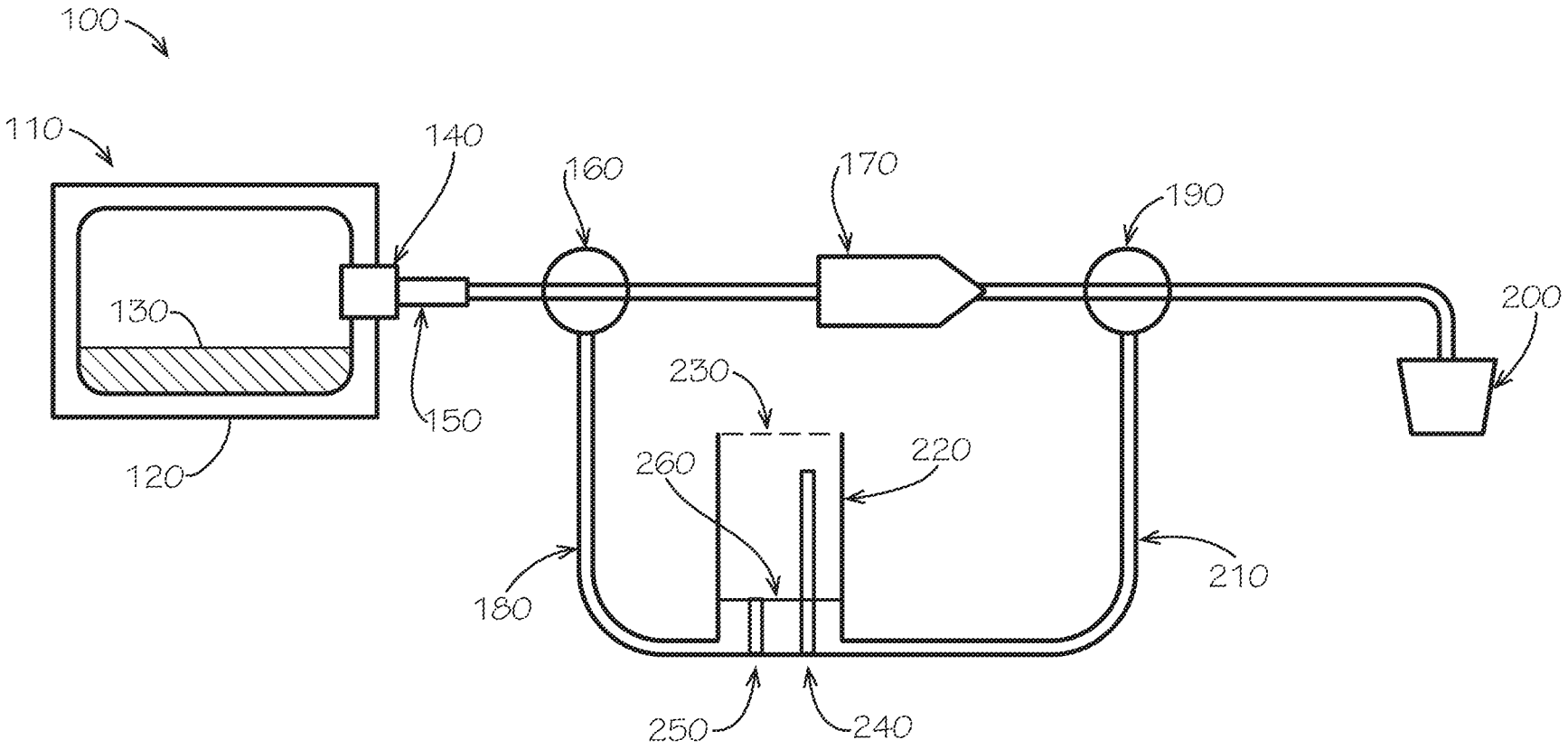
FIG. 2 is a schematic diagram of the beverage dispenser of FIG. 1 in operation.

Referring to FIG. 2, when the beverage dispenser 100 registers a sold-out ingredient, there may be some residual amount of the ingredient 130 left in the ingredient pouch 120. The determination of a sold-out status, i.e., a low level of the ingredient 130 in the ingredient pouch 120, may be made by conventional means. When such a sold-out is registered, the flow of the ingredient 130 to the nozzle 200 stops and no additional drinks may be dispensed until the ingredient pouch 120 may be replaced.

Figure 3:
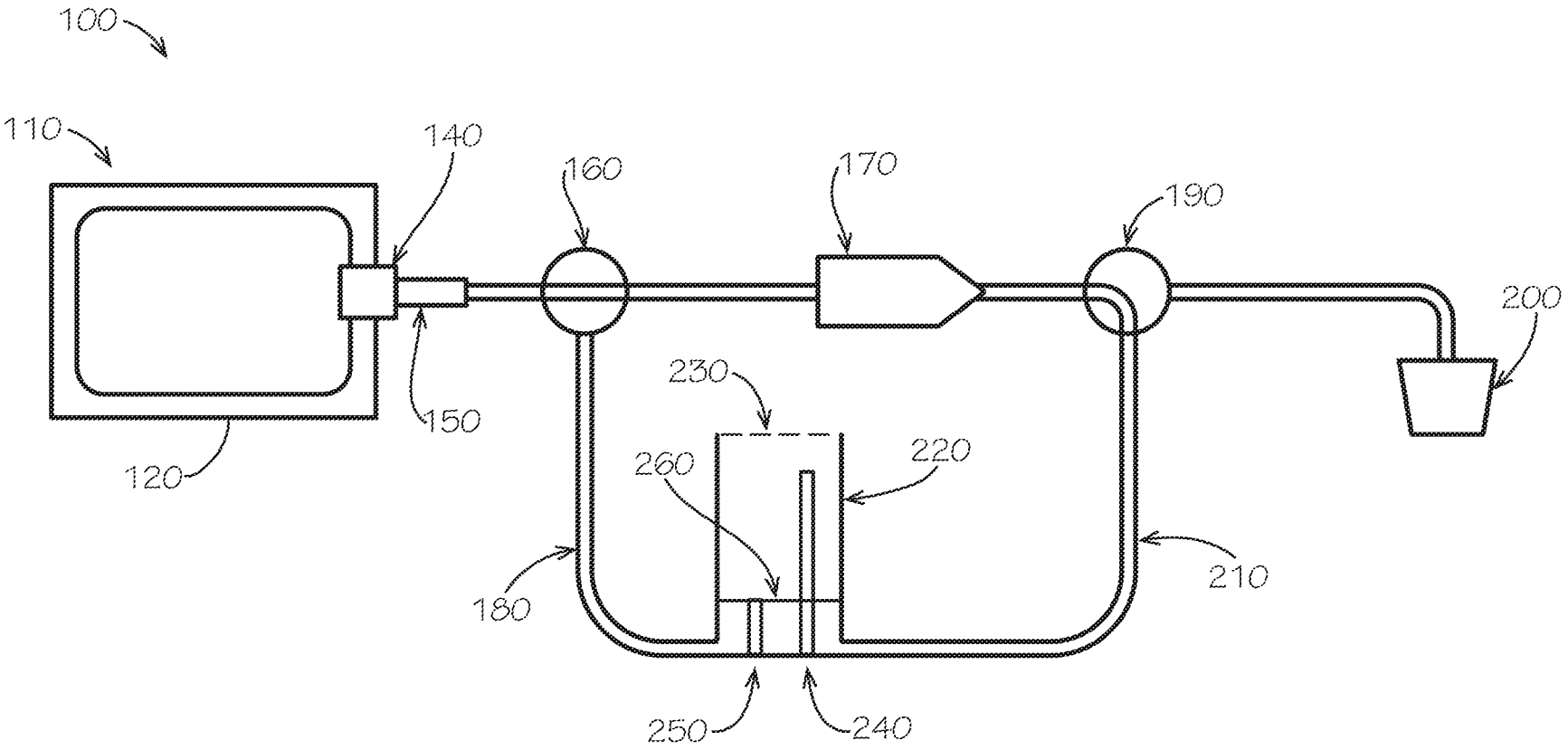
FIG. 3 is a schematic diagram of the beverage dispenser of FIG. 1 in operation.
Figure 4:
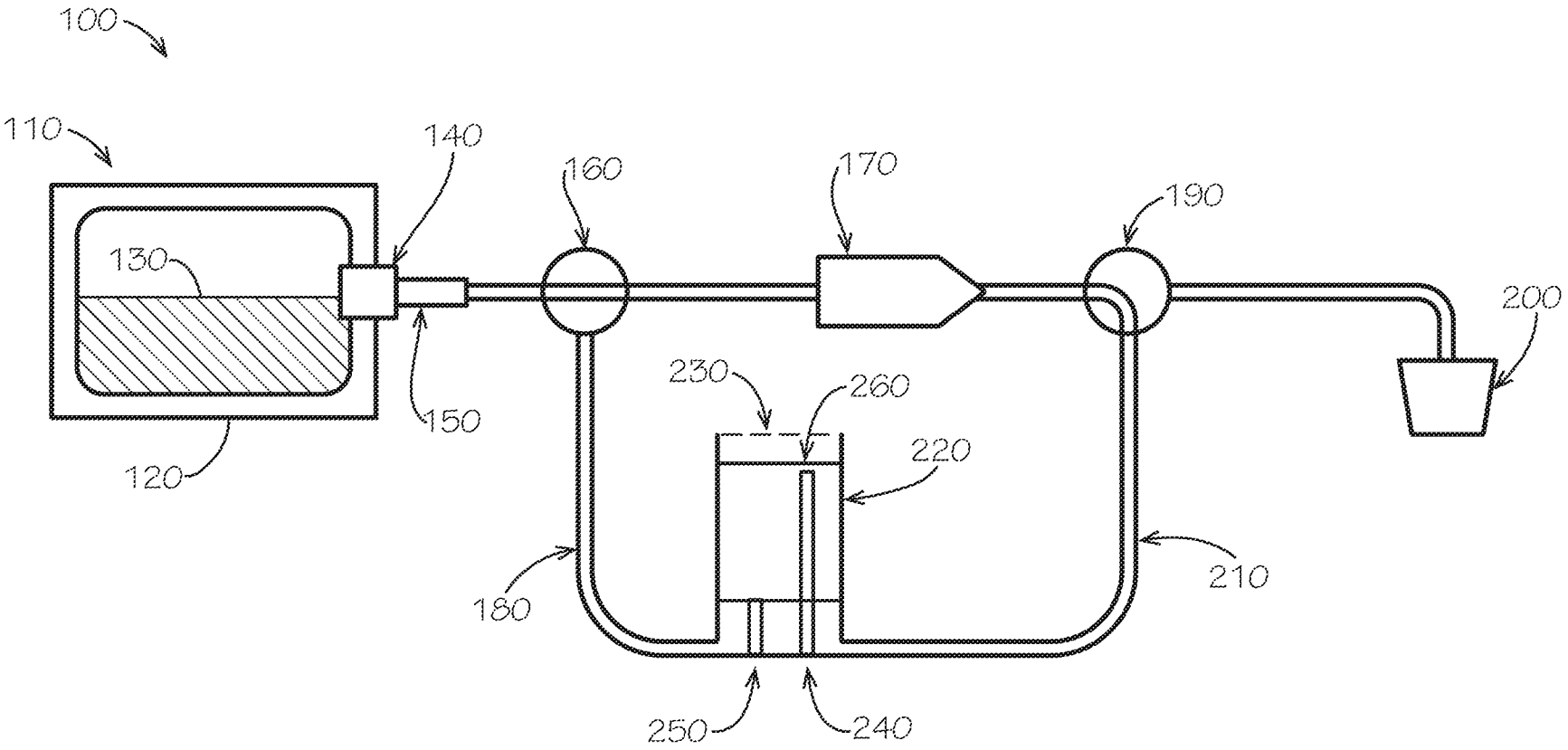
FIG. 4 is a schematic diagram of the beverage dispenser of FIG. 1 in operation.

Referring to FIG. 3, after the sold-out is registered and the flow of the to ingredient 130 to the nozzle 200 has stopped, the outlet three-way diverter valve 190 may be re-configured in a second configuration to connect the outlet of the pump 170 to the ingredient storage tank 220 via the second storage tube 210. The pump 170 may continue to run for some first period of time to reduce the amount of the remnants in the ingredient pouch 120. At the end of the post-sold-out pumping period, the pump 170 may shut off and the ingredient pouch 120 may be substantially empty. The remnants evacuated from the ingredient pouch 120 after the sold-out is registered thus may be stored in the ingredient storage tank 220. A level 260 of the ingredient 130 in the storage tank 220 may rise to a first point between the high level probe 240 and the low level probe 250. Referring to FIG. 4, if during the post-sold-out pumping period, the level 260 of the ingredient 130 reaches the tip of the high level probe 250, it may be assumed that a false sold-out has occurred and an error message may be generated.

Figure 5:
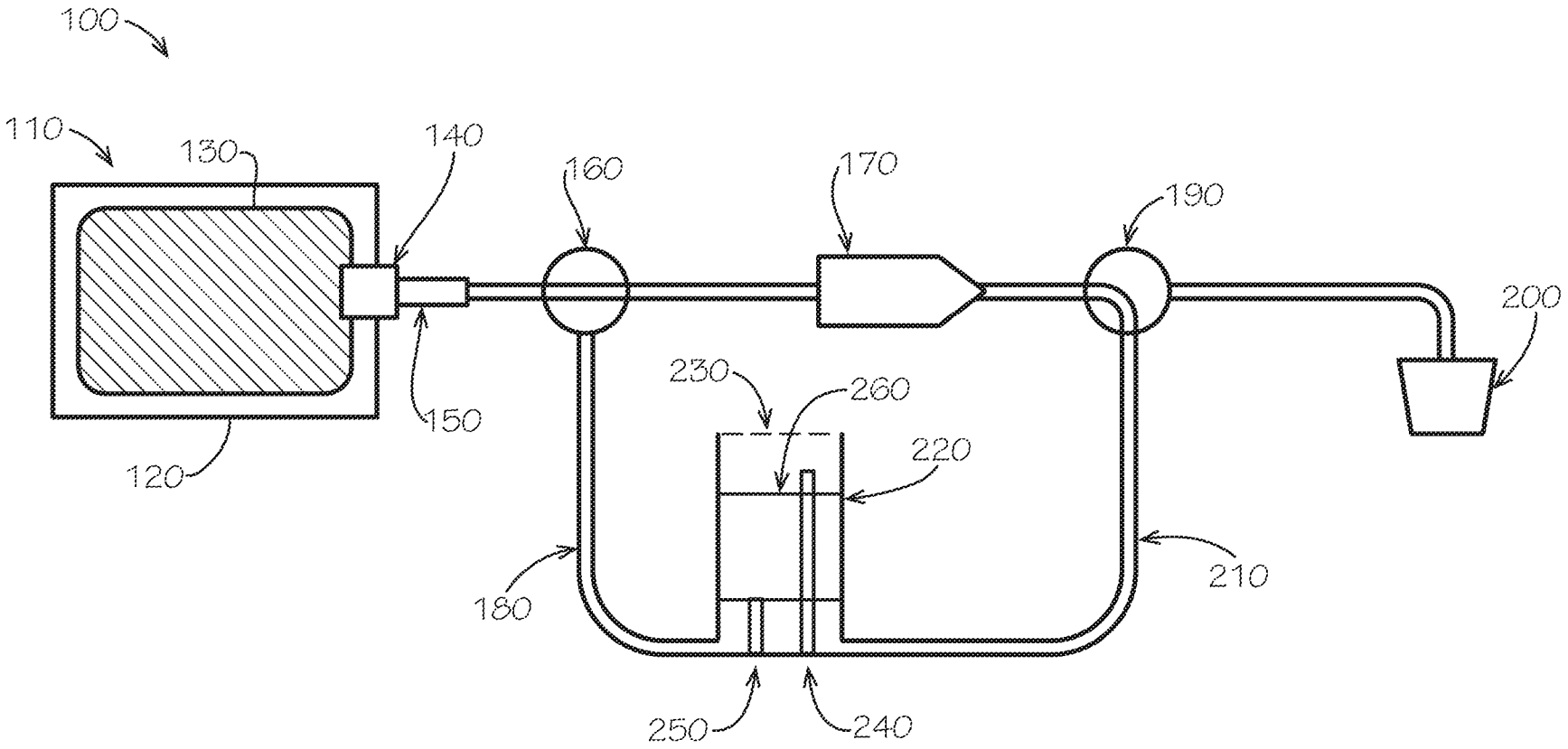
FIG. 5 is a schematic diagram of the beverage dispenser of FIG. 1 in operation.
Figure 6:
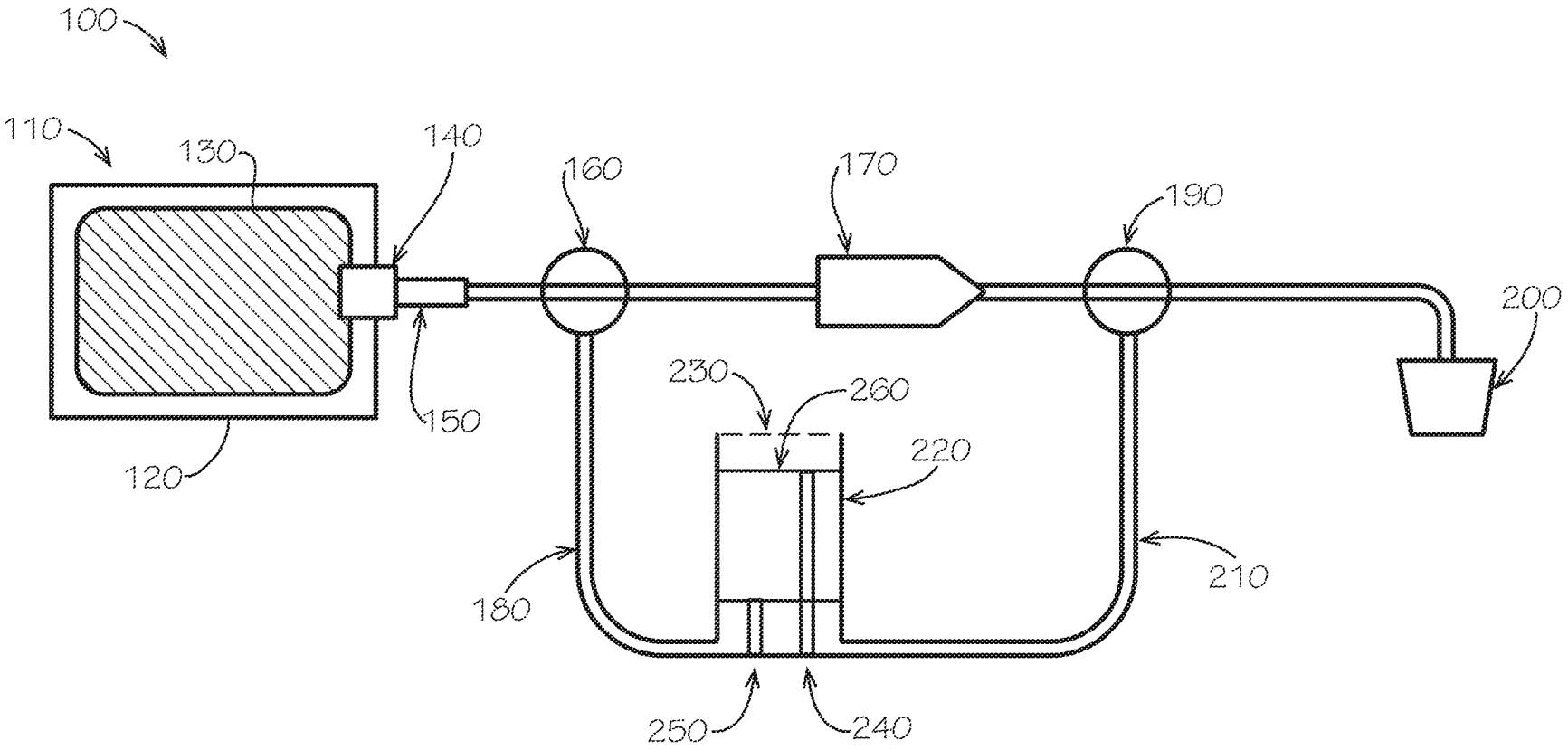
FIG. 6 is a schematic diagram of the beverage dispenser of FIG. 1 in operation.

Referring to FIG. 5, after the ingredient pouch 120 has been replaced, air bubbles may be introduced into the micro-ingredient channel 110. Such an air bubble may be resident in the male IPN fitting 150 or elsewhere. A priming cycle may be required to remove the air bubble. The pump 170 thus may run for some second period of time to pump the ingredient 130 containing the air bubble into the ingredient storage tank 220. The air bubble may rise to the top of the liquid in the ingredient storage tank 220 and may exit the ingredient storage tank 220 via the membrane 230 along with the air inside the ingredient storage tank 220 displaced by the rising ingredient level. At the end of the priming cycle, the level of the ingredient 130 in the ingredient storage tank 220 may rise to a second point between the high level probe 240 and the low level probe 250. Referring to FIG. 6, if during the priming cycle the level of the ingredient 130 reaches the tip of the high-level probe 240, the outlet three-way diverter valve 190 may be re-configured to connect the pump 170 to the nozzle 200 and a conventional priming cycle may be completed.

Figure 7:
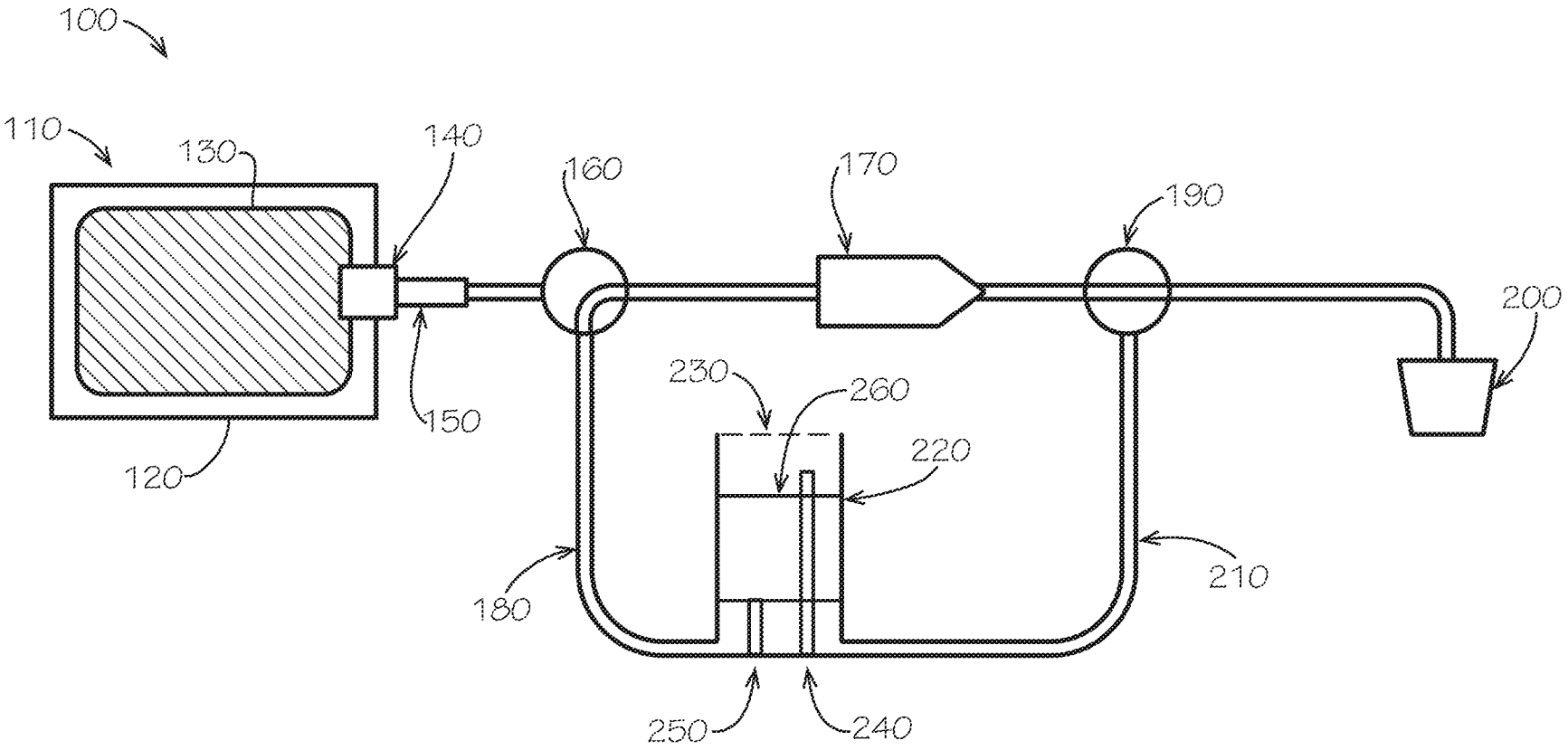
FIG. 7 is a schematic diagram of the beverage dispenser of FIG. 1 in to operation.
Figure 8:
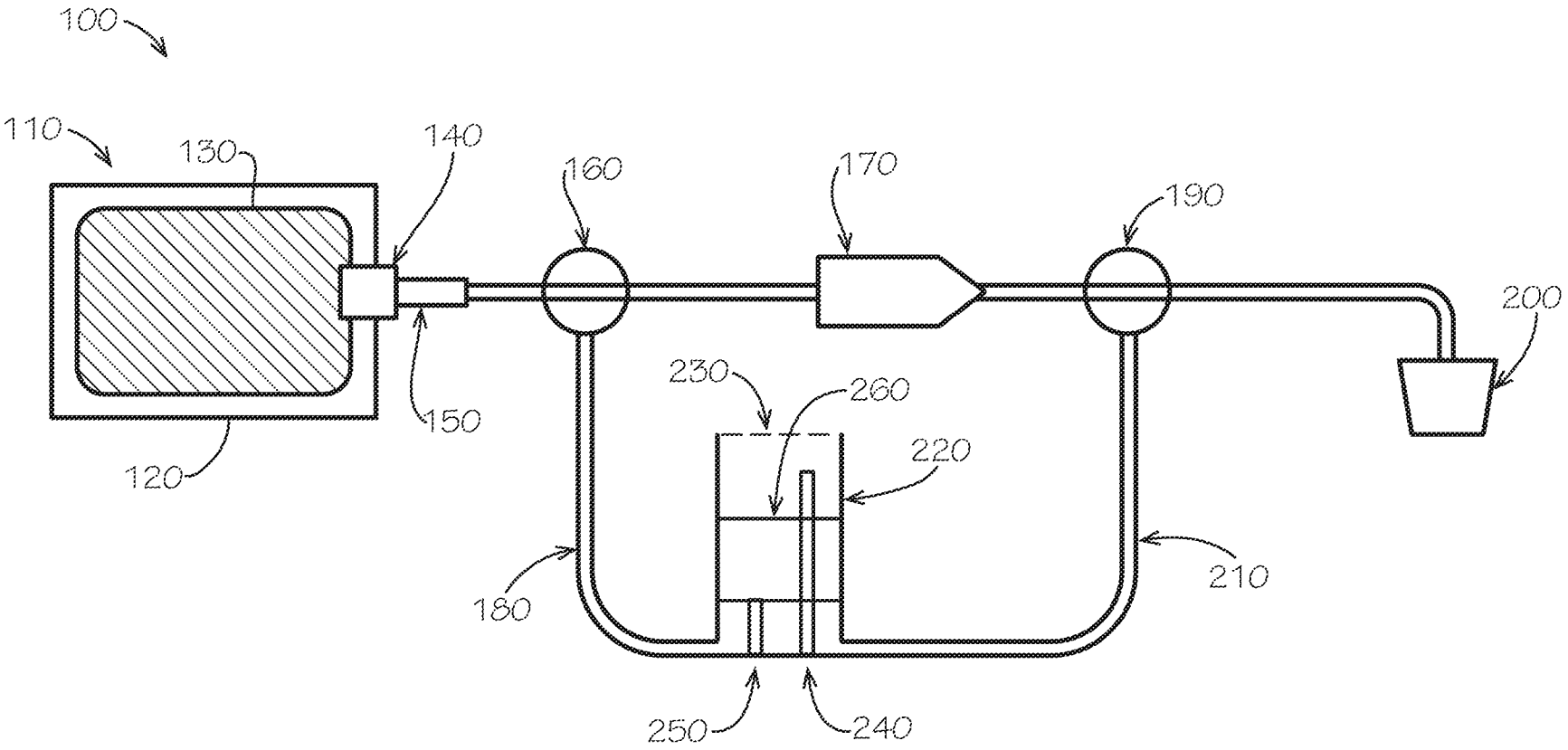
FIG. 8 is a schematic diagram of the beverage dispenser of FIG. 1 in operation.

In a first operating sequence, the ingredient 130 stored in the ingredient storage tank 220 may be dispensed via the nozzle 200 before any of the ingredient 130 may be dispensed from the new ingredient pouch 120. Referring to FIG. 7, the inlet three-way diverter valve 160 may be re-configured to connect the inlet of the pump 170 to the ingredient storage tank 220 via the first storage tube 180. The outlet three-way diverter valve 190 may be re-configured to connect the outlet of the pump 170 to the nozzle 200. As the beverage is dispensed, the level of the ingredient 130 in the ingredient storage tank 220 may drop until the level 260 reaches the tip of the low-level probe 250. At this point in the middle of the dispense, the inlet three-way diverter valve 160 may be re-configured to connect the inlet of the pump 170 to the ingredient pouch 120 and dispensing may continue uninterrupted as shown in FIG. 8.

In an alternative operating sequence, the ingredient 130 stored in the ingredient storage tank 220 may be dispensed via the nozzle 200 after the ingredient 130 is completely dispensed from the ingredient pouch 120. In this scenario, the volume of the ingredient storage tank 220 may be large enough to produce a small number of servings, for example, about five (5) servings or so. In this alternative operating sequence, the ingredient storage tank 220 may serve as a "reserve tank". When the ingredient pouch 120 goes sold-out, a crew member may receive a warning to replace the ingredient pouch 120. During the time in which it takes for the crew member to react to the warning to replace the ingredient pouch 120, the beverage brand(s) corresponding to the ingredient pouch 120 may still be available for some limited number of servings rather than showing as sold-out on the consumer interface.

Figure 9:
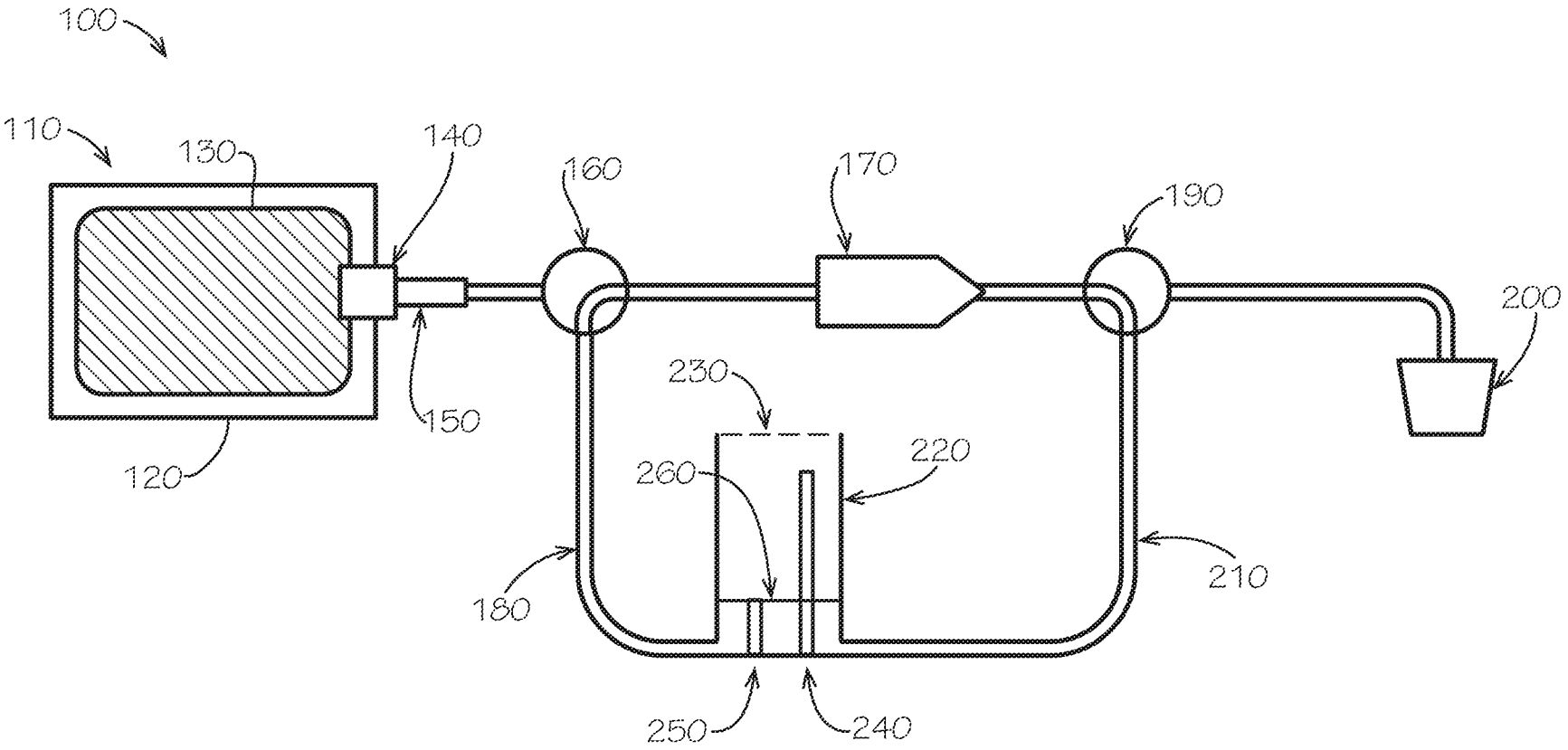
FIG. 9 is a schematic diagram of the beverage dispenser of FIG. 1 in operation.

Referring to FIG. 9, some of the ingredients 130 may require periodic agitation, for example, about ten (10) seconds every two (2) minutes or so. If the ingredient 130 in the micro-ingredient channel 110 requires agitation, the ingredient 130 in the ingredient storage tank 220 may be agitated periodically by configuring the inlet three-way diverter valve 160 to connect the inlet of the pump 170 to the ingredient storage tank 220 and by configuring the outlet three-way diverter valve 190 to connect the outlet of the pump 170 to the ingredient storage tank 220. These configurations may provide a recirculation pattern to agitate the ingredient 130 in the ingredient storage tank 220. The ingredient storage tank 220 also may be used for calibrating the pump 170 by counting the number of pulses (or revolutions) it takes to fill the ingredient storage tank 220 from the low-level probe 250 to the high-level probe 240, thus eliminating the need for a separate manually attached calibration cup. The pumps 170 thus may be automatically self-calibrating. Other components and other configurations may be used herein.

Referring again to FIG. 1, the inlet three-way diverter valve 160 and the outlet three-way diverter valve 190 may be in the first configuration to allow the ingredient 130 to flow straight from the pouch 120 to the nozzle 200 via the pump 170. With an amount of the ingredient 130 extending beyond the pump 170, the pump 170 may be run in reverse periodically to drive an amount of the ingredient 130 back into the ingredient pouch 130 so as to provide turbulence and, hence, agitation to the ingredient 130 therein. The run time of the pump 170 may be limited to ensure that air is not introduced into the ingredient pouch 130. Alternatively, two uni-directional pumps 170 may be used instead of the bi-directional pump 170.

Similarly with respect to FIG. 3, the outlet three-way diverter valve 190 may be re-configured to the second configuration to connect the pump 170 to the ingredient storage tank 220 via the second storage tube 210. The pump 170 may be run in reverse periodically to drive an amount of the ingredient 130 back into the ingredient pouch 130 so as to provide turbulence and, hence, agitation to the ingredient 130 therein. Alternatively, two uni-directional pumps 170 may be used instead of the bi-directional pump 170.

The agitation methods described herein advantageously avoids the use of agitation hardware and the related stress created on the dispenser components. The methods described herein further aid in addressing ingredient separation in the tubes and other components. Other components and other configurations may be used herein.

Figure 10:
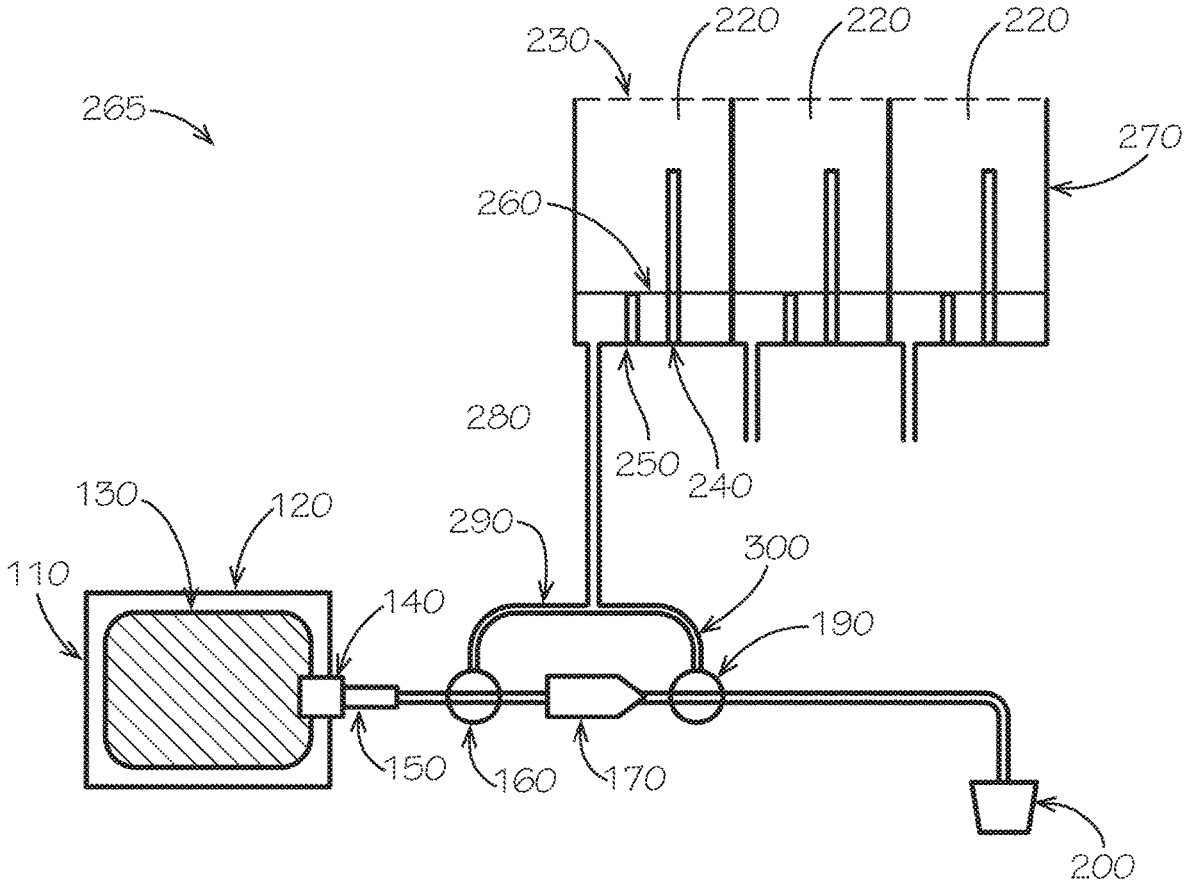
FIG. 10 is a schematic diagram of an alternative embodiment of a beverage dispenser using an ingredient storage tank as may be described herein.

FIG. 10 schematically shows a second embodiment of a beverage dispenser 265 of the present application. A number of the ingredient storage tanks 220 may be grouped in a single location to form a storage tank module 270. Each individual ingredient storage tank 220 serves one micro-ingredient channel 110 and may function in a similar manner to that described above. Specifically, each individual ingredient storage tank 220 may include the high-level probe 240 and the low-level probe 250 with a common membrane 230 thereacross. Each ingredient storage tank 220 may be connected to the three-way diverter valves 160, 190 by a common storage tube 280 that branches into an inlet branch tube 290 and an outlet branch tube 300.

Figure 11:
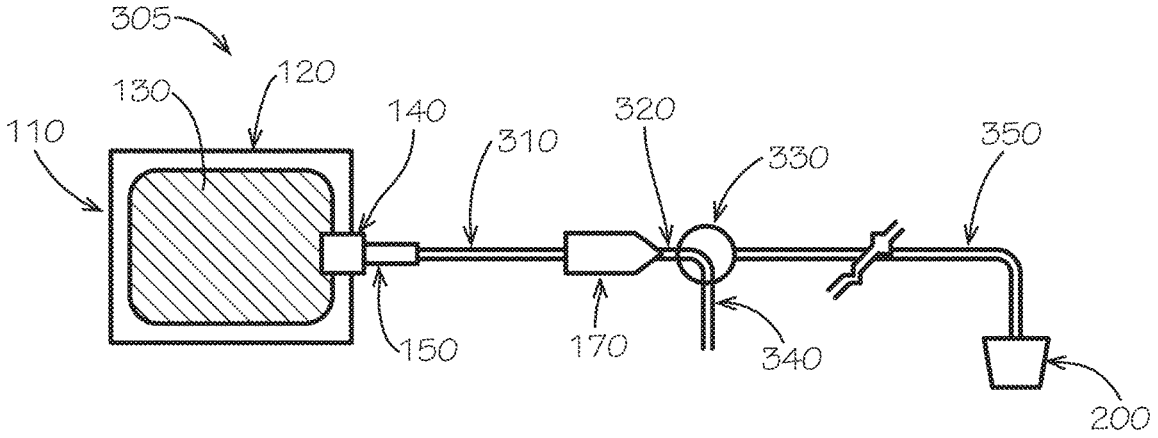
FIG. 11 is a schematic diagram of an alternative embodiment of a beverage dispenser as may be described herein.

FIG. 11 schematically shows a third embodiment of a beverage dispenser 305 of the present application. This embodiment addresses priming the pump 170 after replacing an ingredient pouch 120. The male IPN fitting 150 may be connected to the inlet of pump 170 by a short length of a pump inlet tube 310. The outlet of the pump 170 may be connected to a drain three-way diverter valve 330 by a short length of a pump outlet tube 320. The drain three-way diverter valve 330 may be selectably connected to a drain tube 340 going to a drain and a relatively longer nozzle tube 350 leading to the nozzle 200.

During normal dispensing, the drain three-way diverter valve 330 may be to configured so as to connect the pump outlet tube 320 and the nozzle tube 350. During priming, the drain three-way diverter valve 330 may be re-configured to connect the pump outlet tube 320 to the drain tube 340 and thereby to the drain. The purpose of priming is to remove any air bubbles that may be introduced by replacement of the ingredient pouch 120. Such an air bubble may reside inside the male IPN fitting 150 or elsewhere. The volume that needs to be primed may be only the volume in residence in the male IPN fitting 150, the pump inlet tube 310, the pump 170, and the pump outlet tube 320. The volume of relatively long nozzle tube 350 normally would not contain air bubbles, so the volume of ingredient in residence therein may not need to be purged during a priming cycle.

Although some of the ingredient 130 may be lost, the amount may be significantly less than the current system where a relatively long nozzle tube connects directly to the outlet of the pump 170 and the entire volume of the ingredient 130 in residence from the male IPN fitting to the nozzle would need to be purged during the priming cycle. In practice, the male IPN fitting 150 may be directly attached to the pump 170 and the drain three-way diverter valve 330 may be directly attached to the outlet of the pump 170 without intermediate tubes so as to decrease further the volume of the ingredient 130 that needs to be purged during a priming cycle.

Figure 12:
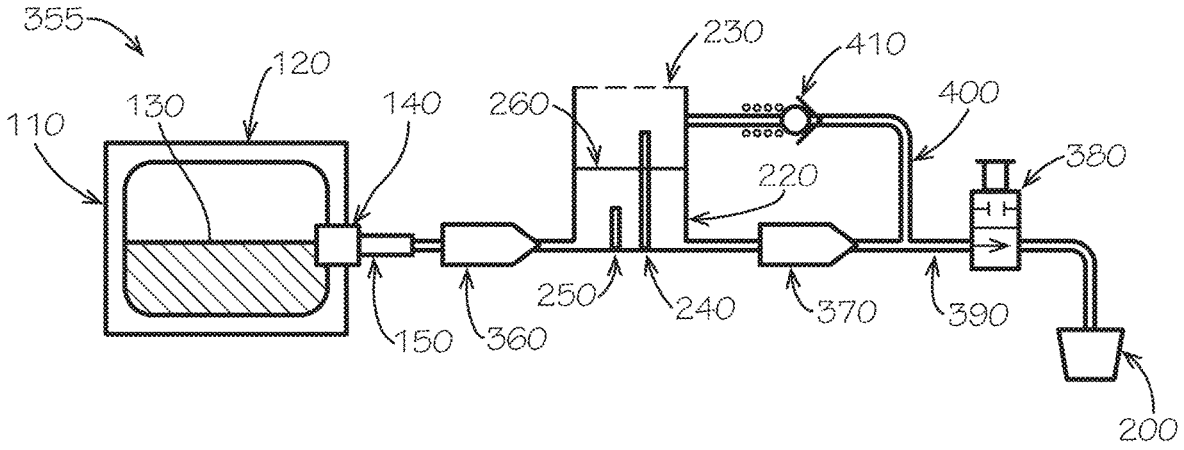
FIG. 12 is a schematic diagram of an alternative embodiment of a beverage dispenser using an ingredient storage tank as may be described herein.
Figure 13:
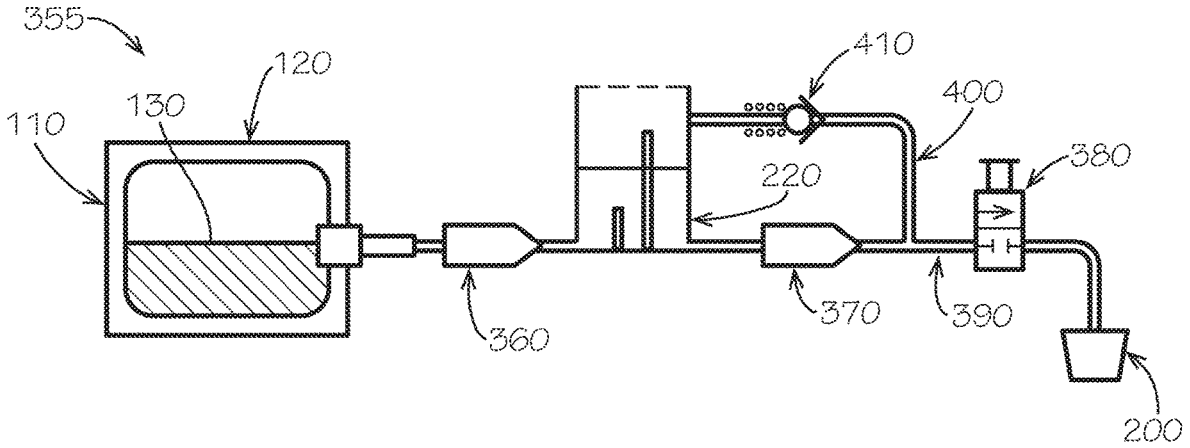
FIG. 13 is a schematic diagram of the beverage dispenser of FIG. 12 in operation.

FIGS. 12 and 13 show a further embodiment of a beverage dispenser 355 as may be described herein. The ingredient pouch 120 may be connected to an inlet of a first pump 360. The outlet of the first pump 360 may be connected to the ingredient storage tank 220. The ingredient storage tank 220 also may be connected to an inlet of a second pump 370. The outlet of the second pump 370 may be connected to an inlet of an on/off solenoid valve 380 via a valve tube 390. Other types of valves may be used herein. The outlet of the on/off solenoid valve 380 may be connected to the nozzle 200. A recirculation tube 400 tees into the valve tube 390 at one end and connects to the ingredient storage tank 220 on the other end. A spring loaded poppet valve 410 may be located along the length of the recirculation tube 400. Other types of valves may be used herein.

During dispensing, as shown in FIG. 12, the solenoid valve 380 may be open and the second pump 370 may draw the ingredient 130 from the ingredient storage tank 220 and send the ingredient 130 to the nozzle 200. The cracking pressure of the spring loaded poppet valve 410 may be, for example, in the range of about 8-12 psi or so. In a normal dispensing situation, the pressure in the valve tube 390 may be below the cracking pressure of the spring loaded poppet valve 350 so the spring loaded poppet valve would remain closed. Other pressures may be used herein.

Referring to FIG. 13, the ingredient 130 in the ingredient storage tank 220 may need to be agitated periodically. During agitation, the solenoid valve 380 may close and the second pump 370 may operate. When the pressure in the valve tube 390 and the recirculation tube 400 exceeds the cracking pressure of spring loaded poppet valve 410, the poppet valve may open so as to allow the ingredient 130 to recirculate back to the ingredient storage tank 220 via the recirculation tube 400 and to create agitation therein.

Whenever the liquid level in the ingredient storage tank 220 drops below the low-level probe 250, the first pump 360 may draw ingredient 130 out of the ingredient pouch 120 and may send the ingredient 130 to the ingredient storage tank 220 until the fluid level 260 reaches the high-level probe 240. If the level 260 drops below the low-level probe 250 during a dispense, both pumps 360, 370 may run simultaneously.

As in previous embodiments, when an ingredient pouch 120 is replaced, any air bubbles that may be introduced into the system at the male IPN fitting 150 or elsewhere may be primed into the ingredient storage tank 220. The priming liquid may subsequently be dispensed from the ingredient storage tank 220. As in previous embodiments, after a sold out is registered, the first pump 360 may continue to reduce the amount of the remnants in the ingredient pouch 120 for some period of time, sending the remnants into the ingredient storage tank 220 for subsequent dispensing.

As in previous embodiments, the volume of the ingredient storage tank 220 may be large enough to create some limited number of servings (for example, about five or so). When the ingredient pouch 120 goes sold-out, a crew member may receive a warning to replace the ingredient pouch 120. During the time in which it takes for the crew member to react to the warning to replace the ingredient pouch 120, the brand(s) corresponding to the ingredient pouch 120 still may be available for some limited number of servings rather than showing as sold-out on the consumer interface.

Figure 14:
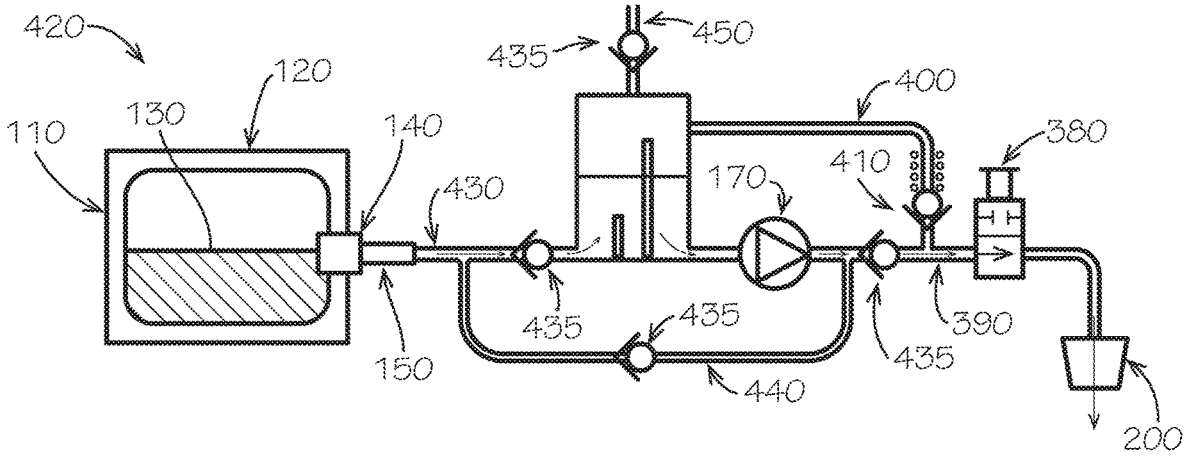
FIG. 14 is a schematic diagram of an alternative embodiment of a beverage dispenser using an ingredient storage tank as may be described herein.
Figure 15:
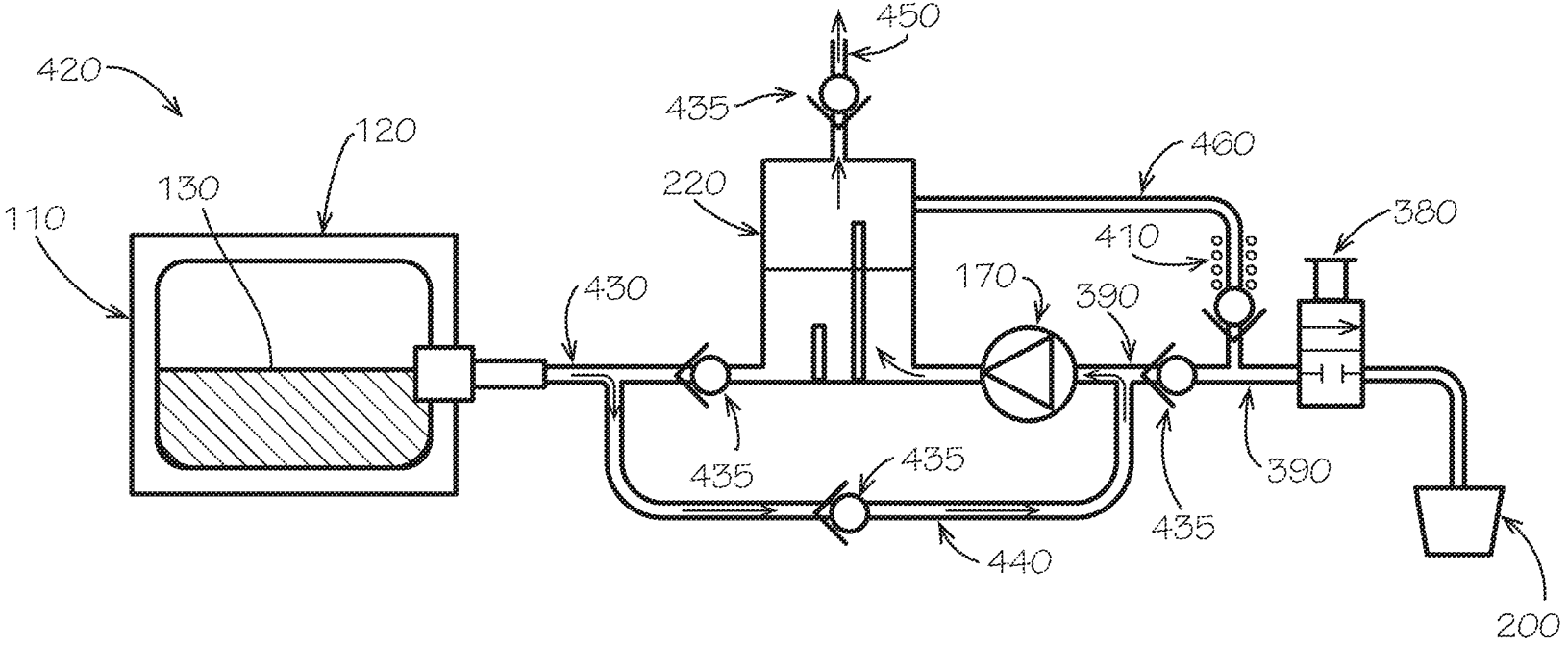
FIG. 15 is a schematic diagram of the beverage dispenser of FIG. 14 in operation.
Figure 16:
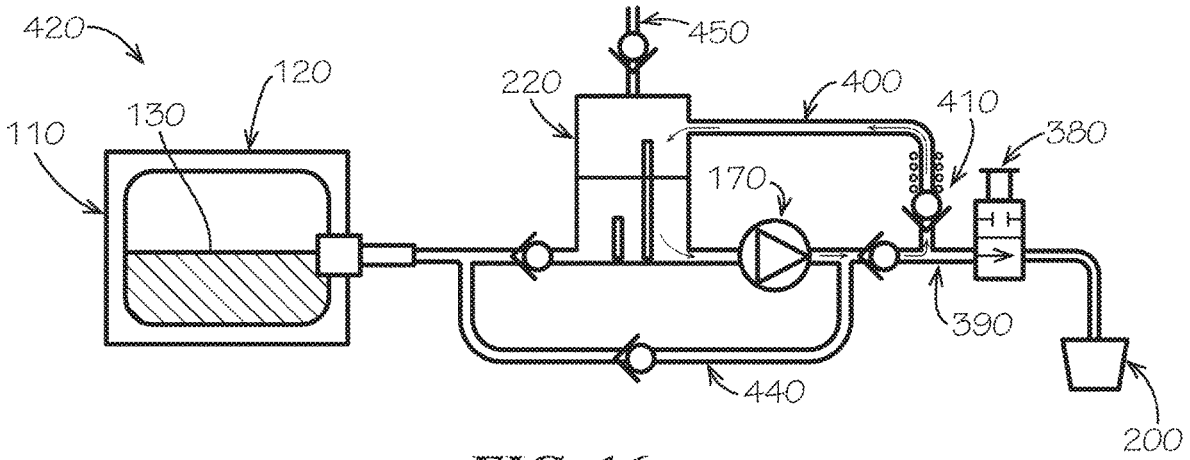
FIG. 16 is a schematic diagram of the beverage dispenser of FIG. 14 in operation.

Referring to FIGS. 14-16, this embodiment of a beverage dispenser 420 of the present application shows an example of a vacuum side air vent. Referring to FIG. 14, during normal dispensing, the solenoid valve 380 may be open and the pump 170 may run forward so as to draw the ingredient 130 from the ingredient storage tank 220 and sending the ingredient 130 to the nozzle 200 via the valve tube 390. The vacuum drawn in the ingredient storage tank 220 as the ingredient 130 is removed in turn draws liquid from the ingredient pouch 120 via a storage tank inlet tube 430. The pump 170 may be any type of a reversible pump. A number of check valves 435 may be used herein.

Referring to FIG. 15, when the level of the liquid in the ingredient storage tank 220 drops below the low-level probe 250, the solenoid valve 380 may close and the pump 170 may reverse. The pump 170 running in reverse may draw the ingredient 130 from the ingredient pouch 120 via the tank inlet tube 430, the valve tube 390, and a storage tank by-pass tube 440. The pump 170 runs in reverse until the liquid level 260 reaches the high-level probe 240. Air pressure generated as the liquid level rises in the ingredient storage tank 220 may be vented out via a vent tube 450. If the liquid level 260 fails to reach the high level probe 240 after some predetermined period of time, a sold-out may be registered.

Referring to FIG. 16, when the ingredient 130 in the ingredient storage tank 220 needs to be periodically agitated, the solenoid valve 380 may close and the pump 170 may run forward. Running forward, the pump 170 draws liquid out of the ingredient storage tank 220 and sends the ingredient 130 into the valve tube 390. When the cracking pressure of spring loaded poppet valve 410 is exceeded, the poppet valve 410 may open so as to allow the ingredient 130 to flow via the recirculation tube 400 back to the ingredient storage tank 220 so as to create a recirculating pattern that provides agitation.

As in previous embodiments, when an ingredient pouch 120 is replaced, any air bubbles that may be introduced into the system at the male IPN fitting 150 or elsewhere may be primed into the ingredient storage tank 220. The priming liquid subsequently may be dispensed from the ingredient storage tank 220. As in previous embodiments, after a sold out is registered, the pump 170 may continue to reduce the amount of the remnants in the ingredient pouch 120 for some period of time, sending the remnants into the ingredient storage tank 220 for subsequent dispensing.

As in previous embodiments the volume of the ingredient storage tank 220 may be large enough to create some limited number of servings (for example, about five servings or so). When the ingredient pouch 120 goes sold-out, a crew member may receive a warning to replace the ingredient pouch 120. During the time in which it takes for the crew member to react to the warning to replace the ingredient pouch 120, the beverage brand(s) corresponding to the ingredient pouch 120 may still be available for some limited number of serving rather than showing as sold-out on the consumer to interface.

Figure 17:
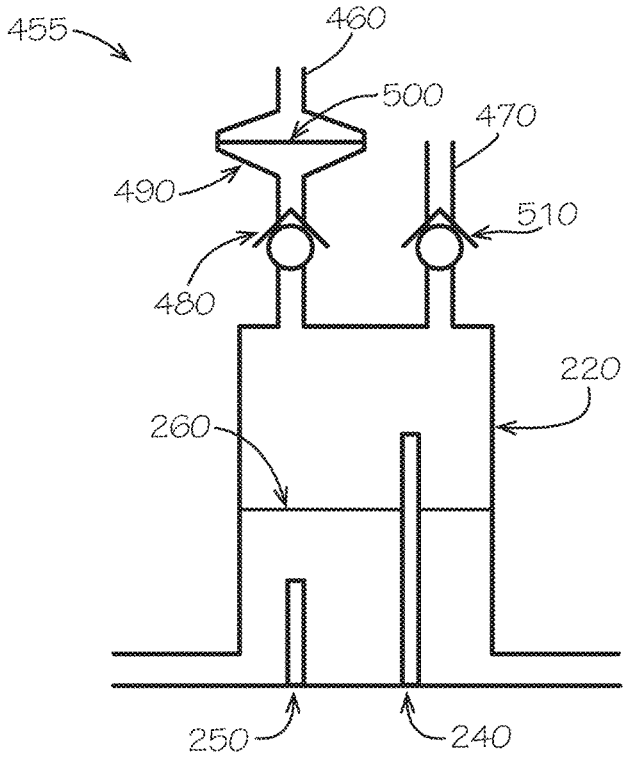
FIG. 17 is a schematic diagram of a filter for an ingredient storage tank as may be described herein.

Referring to FIG. 17, an alternative embodiment of a membrane system 455 is shown. If an ingredient splashes onto the membrane 230, then the membrane 230 may become clogged as dried ingredient builds up thereon. The alternative shown herein may prevent this problem. A first membrane tube 460 and a second membrane tube 470 may be connected to the top of the ingredient storage tank 220. The first membrane tube 460 may contain a downward facing check valve 480 that may connect to a filter housing 490 containing one or more filters 500. The second membrane tube 470 may contain an upward facing check valve 510. As the level 260 of the ingredient 130 rises, the ingredient 130 forces air inside the ingredient storage tank 220 out of the second membrane tube 470 via the upward facing check valve 510. As the level 260 of the ingredient 130 lowers, the ingredient 130 draws air through first membrane tube 460 and thereby through the filter 500 and the downward facing check valve 480. The filter 500 removes contaminants in the air entering the ingredient storage tank 220. Other components and other configurations may be used herein.

It should be apparent that the foregoing relates only to the preferred embodiments of the present application and the resultant patent. Numerous changes and modifications may be made herein by one of ordinary skill in the art without departing from the general spirit and scope of the invention as defined by the following claims and the equivalents thereof

We claim:

1. A beverage dispensing system for combining a number of ingredients, comprising:
   an ingredient pouch;
   an ingredient storage tank;
   a pump;
   a nozzle;
   an inlet diverter valve upstream of the pump; and
   an outlet diverter valve downstream of the pump;
   wherein the outlet diverter valve comprises a first outlet configuration for the pump to pump the ingredient from the ingredient pouch directly to the nozzle and a second outlet configuration for the pump to pump the ingredient from the ingredient pouch to the ingredient storage tank.

2. The beverage dispensing system of claim 1, wherein the inlet diverter valve comprises a first inlet configuration for the pump to pump the ingredient from the ingredient pouch to the nozzle and a second inlet configuration for the pump to pump the ingredient from the ingredient storage tank to the nozzle or to recirculate the ingredient in the ingredient storage tank.

3. The beverage dispensing system of claim 1, wherein the inlet diverter valve and the outlet diverter valve comprise a three-way diverter valve.

4. The beverage dispensing system of claim 1, wherein the ingredient storage tank comprises a high level probe and a low level probe.

5. The beverage dispensing system of claim 1, wherein the ingredient storage tank comprises a liquid impervious membrane.

6. The beverage dispensing system of claim 1, wherein the ingredient pouch is in communication with the inlet diverter valve via a tube and wherein the ingredient pouch comprises a female fitting and wherein the tube comprises a male fitting.

7. The beverage dispensing system of claim 1, further comprising a plurality of ingredient storage tanks in a storage tank module.

8. The beverage dispensing system of claim 1, wherein the ingredient storage tank comprises a first membrane tube with a filter and a first check valve and a second membrane tube with a second check valve.

9. The beverage dispensing system of claim 1, wherein the number of ingredients comprises micro-ingredients.

10. A method of pumping an ingredient from an ingredient pouch to a nozzle, comprising:
   pumping the ingredient to the nozzle;
   determining a low level of the ingredient in the ingredient pouch;
   pumping the remaining ingredient to an ingredient storage tank;
   replacing the ingredient pouch; and
   pumping a portion of the ingredient back to the ingredient pouch.

11. The method of claim 10, further comprising the step of priming the replacement ingredient pouch by pumping the ingredient to the ingredient storage tank.

12. The method of claim 10, further comprising the step of pumping the ingredient from the ingredient storage tank to the nozzle.

13. The method of claim 10, further comprising the step of recirculating the ingredient in the ingredient storage tank.

* * * * *